United States Patent [19]

Conger, IV

[11] Patent Number: 4,997,342

[45] Date of Patent: Mar. 5, 1991

[54] AIR BLOWER WITH FLEXIBLE HOUSING

[76] Inventor: William W. Conger, IV, 9552 Orange Ave., Anaheim, Calif. 92804

[21] Appl. No.: 434,225

[22] Filed: Nov. 13, 1989

[51] Int. Cl.[5] ..... F01D 29/60

[52] U.S. Cl. ..... 415/214.1; 415/200; 417/423.14; 417/423.15

[58] Field of Search ..... 415/214.1, 206, 203, 415/213.1, 200, 119; 417/423.2, 423.15, 423.14, 423.10, 369, 312; 403/288, 359, 364, 373, 374; 285/412, 406; 181/225, 205, 202, 243

[56] References Cited

U.S. PATENT DOCUMENTS

| | | | |
|---|---|---|---|
| 1,765,784 | 6/1930 | Aldinger . | |
| 2,085,433 | 6/1937 | Lofgren | 183/37 |
| 2,253,310 | 8/1941 | Smellie | 15/18 |
| 2,433,589 | 12/1947 | Adams | 415/214.1 |
| 2,875,947 | 3/1959 | Bradley | 417/366 X |
| 2,972,160 | 2/1961 | Hahn | 417/423.2 |
| 3,308,608 | 3/1967 | Brimberg | 55/276 |
| 3,599,273 | 8/1971 | Shirayanagi et al. | 15/326 |
| 3,961,382 | 6/1976 | Peterson, Jr. | 417/423.14 |
| 4,202,654 | 5/1980 | Marlow | 415/213.1 |
| 4,230,438 | 10/1980 | Lehman et al. | 415/229 |
| 4,288,886 | 9/1981 | Siegler | 15/330 |
| 4,665,581 | 5/1987 | Oberdorfer | 15/326 |
| 4,734,017 | 3/1988 | Levin | 417/366 |

FOREIGN PATENT DOCUMENTS 2812809 9/1979 Fed. Rep. of Germany ..... 415/206

*Primary Examiner*—John T. Kwon
*Assistant Examiner*—John Ryznic
*Attorney, Agent, or Firm*—Poms, Smith, Lande & Rose

[57] ABSTRACT

An air blower includes an axial flow through assembly of motor and fan housing mounted in an axial flow through motor casing. The casing includes two sections formed of an injection molded, soft, resilient, elastomeric material which sections are basically cylindrical with closed ends at which are formed axially aligned flow through input and output air fittings. The inner end of each casing section is enlarged and the two abutted together to form a fan housing receiving chamber that tightly and elastically receives the fan housing. One end of the fan housing seats against the shoulder in the enlarged end of one casing section, and the other end of the fan housing seats against a plurality of positioning and reinforcing fingers integral with and spaced around the inner surface of the enlarged end of the other casing section. A number of circumferentially spaced, axially extending bolts pull the two casing sections together to tightly clamp the fan housing, and thereby the motor, to and within the enlarged housing receiving chamber of the casing sections.

19 Claims, 2 Drawing Sheets

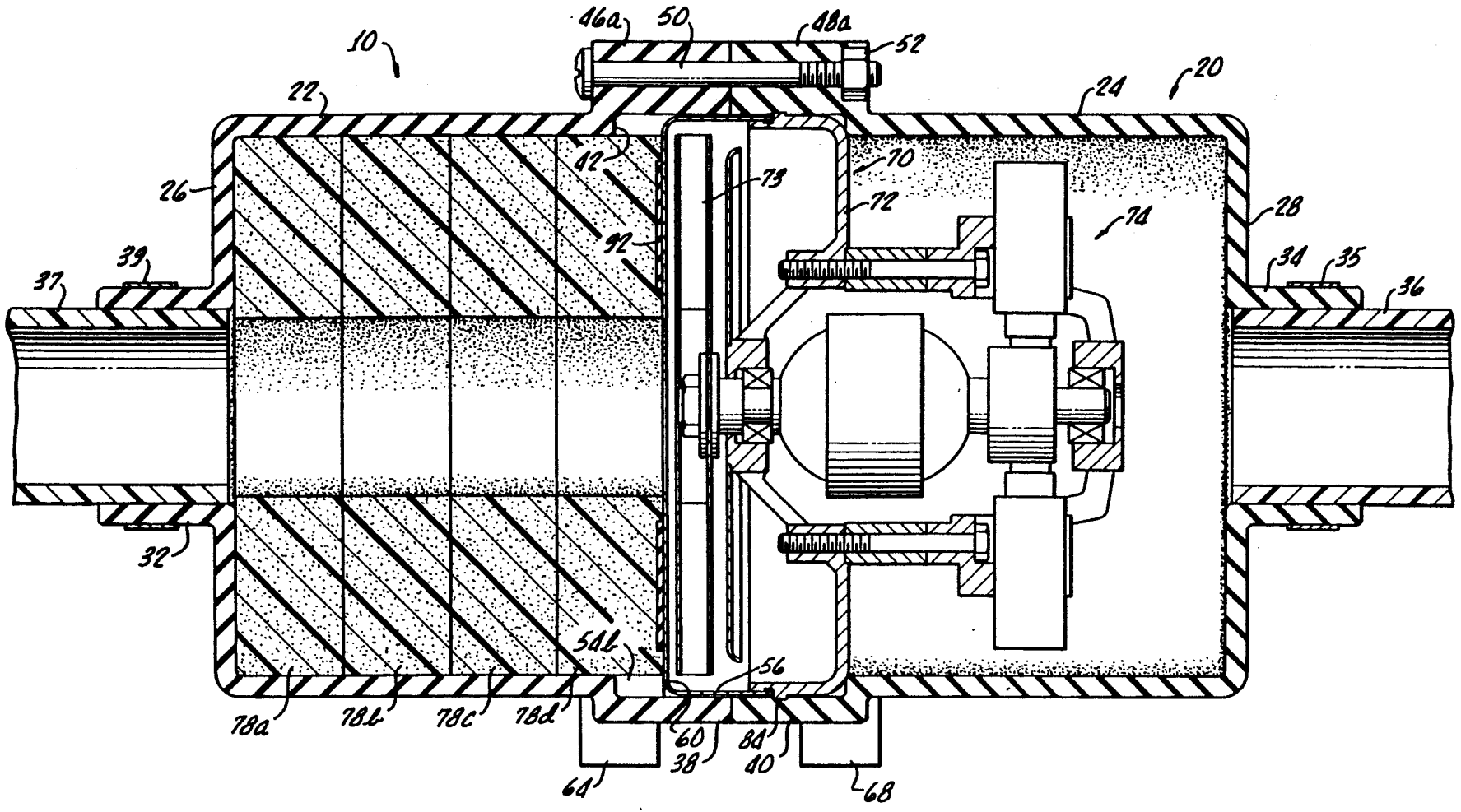
10
20
22
24
26
28
32
34
35
36
37
38
39
40
42
46a
50
52
54b
56
60
64
68
70
72
74
78a
78b
78c
78d
80
92

AIR BLOWER WITH FLEXIBLE HOUSING

BACKGROUND OF THE INVENTION

The present invention relates to air blowers for therapy pools, hot tubs, spas and the like, and more particularly concerns an improved low noise, decreased vibration and greatly simplified mounting and casing for the motor blower assembly of the blower.

Air blowers for therapy pools, hot tubs, spas and the like are notoriously noisy. They move large volumes of air through constricted areas and inherently require connection between the rotating motor and blower parts and rigid structures, such as plumbing connected to the blower casing. Noise and vibration of the blower are often greatly amplified by the connected plumbing and structure. Sound insulation material is often provided within the blower cover adjacent the air intake to help reduce undesired noise. Some blower motors employ flexible mounting for the blower motor assembly. Such blowers generally include a hard, rigid case and a flexible vibration absorbing or isolating mounting. In such flexible mounting arrangements resilient elements interconnect the motor blower assembly and the generally rigid system housing, requiring various complex structures and configurations for particular interconnection of rigid elements to flexible elements.

In a co-pending application of the present inventor, Ser. No. 234,377, filed Aug. 19, 1988, for Vibration Dampened Blower, a unique flexible annulus has a reinforced outer edge that is integrally molded to and within a short rigid blower housing ring section to provide improved and simplified interconnection of the vibration absorbing flexible mounting annulus and the rigid housing.

In blower mountings of the prior art, clamped or bolted connections between resilient and rigid elements have been employed which are complex and costly, often requiring additional assembly steps and additional clamping parts and bolts. Where bolts go through the flexible element, the latter is significantly weakened, whereby strength, life and stability of the resulting connection are compromised. Moreover, even where more complex vibration mounts are employed, the system uses rigid casings or housing elements, and these will still experience some vibration and thus add to the noise generated by the instrument.

Accordingly, it is an object of the present invention to provide an improved motor blower assembly which avoids or minimizes above-mentioned problems.

SUMMARY OF THE INVENTION

In carrying out principles of the present invention in accordance with a preferred embodiment thereof, an air blower is formed of first and second casing sections made of a relatively soft elastomeric material, with each casing section comprising a cylindrical body having a first diameter and an enlarged open inner end, which inner ends collectively define a fan housing receiving chamber that is configured and arranged to closely and tightly envelope the fan housing, with inner edges of the enlarged inner ends being in close engagement with each other. The fan housing is captured within the receiving chamber with the motor received in one of the casing sections, and means are provided to axially draw the flexible, resilient sections toward each other to firmly, securely and resiliently clamp the fan housing therebetween, so that pressure exerted on the housing by the enlarged inner ends securely and tightly mounts the fan housing to and within the casing sections.

BRIEF DESCRIPTION OF THE DRAWINGS

FIG. 3 is a longitudinal cross section, to a larger scale, of the motor blower assembly of FIG. 1.

DETAILED DESCRIPTION OF THE INVENTION

Figure 2:
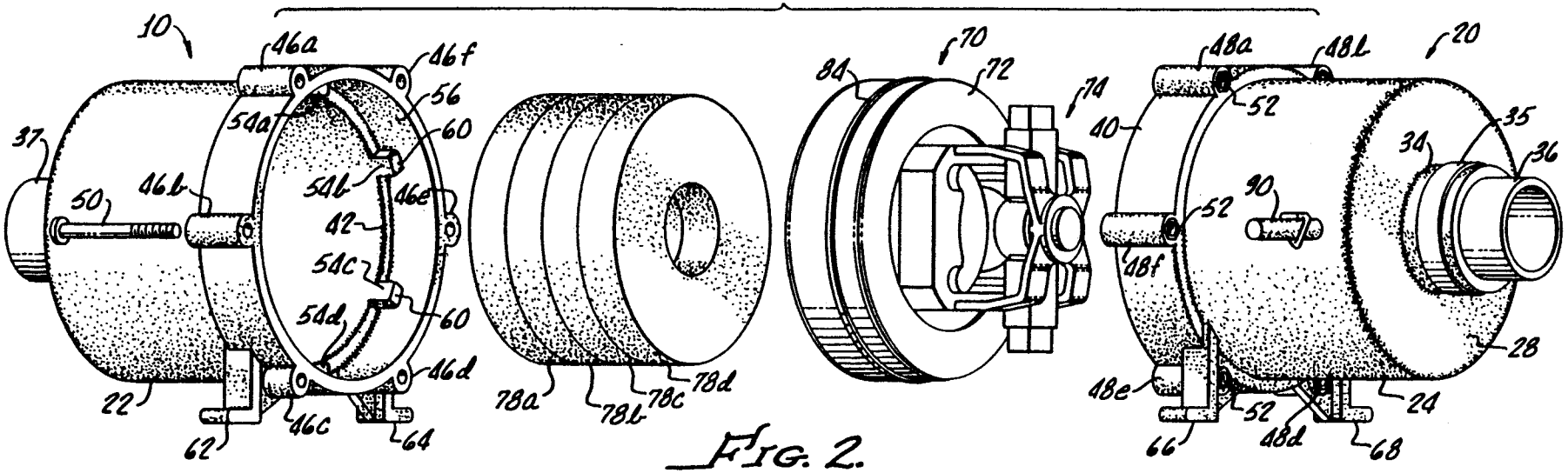
FIG. 2 is an exploded pictorial view, to a larger scale, of portions of the blower assembly of FIG. 1.
Figure 1:
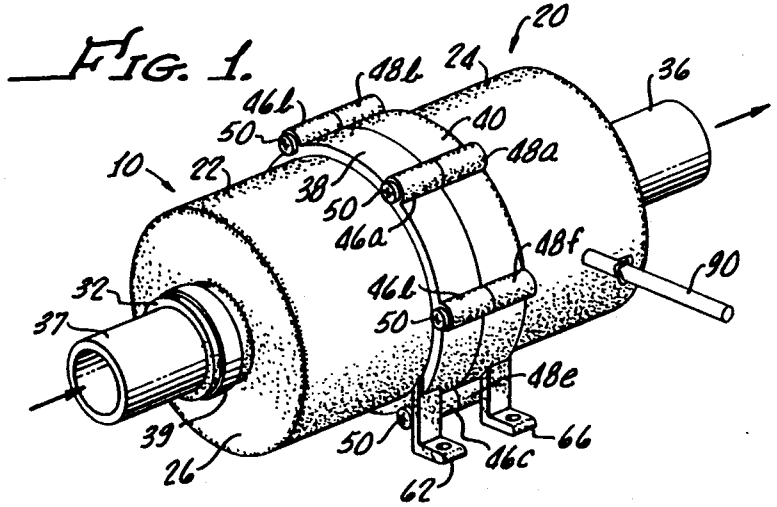
FIG. 1 is a pictorial illustration of an air blower assembly embodying principles of the present invention.

As illustrated in FIG. 1, an air blower assembly embodying principles of the present invention is to be used preferably indoors, as the air blower for a therapy pool, hot tub, spa or the like. The blower has an input section for drawing air from ambient atmosphere and an output conduit that is connected to the therapy pool, hot tube, spa or the like. The motor blower of FIG. 1 is an in-line or straight through blower embodying first and second elastomeric casing sections 10,20, each having a right circular cylindrical body section 22,24, and a closed outer end 26,28 (see FIG. 2). Ends 26 and 28 are substantially circular disc shaped and include centrally positioned, axially directed and mutually axially aligned air fittings 32,34, with air fitting 32 being an input fitting, and fitting 34 being an output fitting adapted to be connected, as by a clamping band 35, to a conduit 36 that leads to the hot tub, therapy pool or spa. Similarly input fitting 33 may be connected to an air input conduit 37 by a clamp band 39.

The individual casing sections 10,20 are substantially similar, and each is integrally injection molded of a soft, flexible, resilient plastic material, such as a PVC elastomer. A material useful in molding casing sections is made and sold by B. F. Goodrich as GEON compound 8804-022, having a hardness of 88-A on a Shore C scale. This material has been tested and approved by Underwriters Laboratories as recognized compound plastics QMF22.

Another material useful for molding the casing sections is B. F. Goodrich GEON compound 8884FR. Both materials are identified and approved by Underwriters Laboratories as type U. L. 94VO.

The GEON compound 8884FR has been suggested for use as insulation for thermoplastic insulated building wire. This material has typical test properties as follows:

| | | | |
|---|---|---|---|
| ASTM | D2240 | Instantaneous Hardness | 79C (Shore C Scale) |
| ASTM | D 792 | Specific gravity | 1.29 |
| ASTM | D 412 | Tensile Strength | 17.2 (2500) psi |
| ASTM | D 412 | Modulus at 100% Elongation | 12.4 (1800) psi |
| ASTM | D 412 | Elongation | 290% |
| ASTM | D 476 | Brittleness Temperature | −18° C. |
| ASTM | D 257 | Volume Resistivity at 95° C. | 1.5 ohm-cm × $10^{12}$ |
| ASTM | D2863 | Oxygen Index | 29% |

At the inner end of each casing section remote from its air fitting is an enlarged (increased diameter) open inner end 38,40 joining the body sections 22,24 to form axially facing shoulders 42 and 44. Enlarged inner ends 38,40 are of a slightly greater thickness (about 7/32 inches) than the body sections 22,28 (about 5/32 inches). Integrally formed with each enlarged inner section and extending substantially the relatively short length of the inner sections are a plurality of circumferentially spaced substantially cylindrical bosses 46*a*, 46*b*, 46*c*, 46*d*, 46*e*, and 46*f*, on enlarged end 38, and 48*a*, 48*b*, 48*d*, 48*e*, and 48*f* on enlarged inner end 40. A boss on end 40, mating with boss 46*c* on end 38 is not seen in the drawings. The bosses are formed with axially aligned apertures for receipt of a plurality of headed bolts, such as bolts 50 shown in FIGS. 1 and 2, which cooperate with nuts 52 captured in non-circular shaped (hexagonal) recesses at the outer ends of the bosses 48 of inner end section 40.

Figure 4:
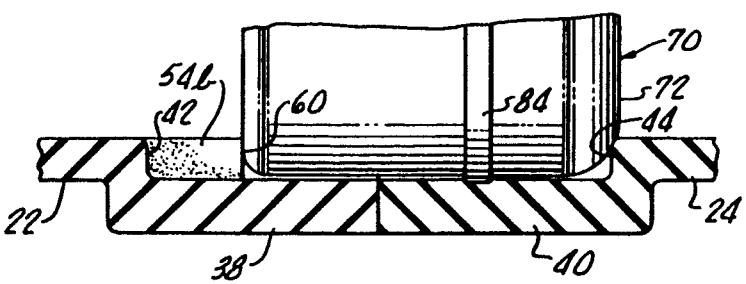
FIG. 4 is an enlarged detailed and fragmentary sectional view showing the interengagement of positioning and reinforcing fingers with the fan housing.

Integrally formed with the inner surface of enlarged inner end 38 are a plurality of positioning and reinforcing fingers 54*a*, 54*b*, 54*c*, 54*d* and two others (not shown in the drawings) similarly positioned and spaced. The fingers project radially inwardly from the inner surface 56 of inner end 38 and have a radial thickness equal to the radial thickness of shoulder 42 (see FIG. 4), the latter having an extent substantially equal to the wall thickness of the casing body 22. The fingers extend axially from the shoulder 42 for slightly less than about one half of the axial length of the enlarged inner end 38 and have end portions, such as end portion 60 of finger 54*b*, that provide seats for the fan housing, to be described below. All of seats 60 are positioned in a common plane at a fixed distance inwardly of the free edge of the casing section to provide a common seat for one end of the fan housing.

It is presently preferred to employ six pairs of bosses 46,48 and six fingers 54 spaced evenly around the casing, although more or fewer bosses and fingers may be used. The fingers are circumferentially positioned between the bosses so that axial tensile forces may be exerted evenly on both sides of each finger.

Integrally formed with the respective casing sections and projecting outwardly from the intermediate section of the casing, primarily from the enlarged inner ends 38 and 40, are a pair of spaced L-shaped elastomeric support legs 62,64 for casing section 10, and legs 66,68 for casing section 20.

The casing sections securely mount a fan and motor assembly, generally indicated at 70, and including a right circular cylindrical fan housing 72 to which is fixedly secured a motor 74 connected in driving relation to fan blades 73 (FIG. 3) mounted within the housing 72. As can be seen in the drawings, both the motor and the fan housing and blades are arranged for axial flow through passage of air.

To deaden the sound of the air intake as air is sucked in through input fitting 32, the smaller diameter body portion 22 of casing section 80 is substantially entirely filled with a plurality of idential annular discs of an air cell foam plastic, including discs 78*a*, 78*b*, 78*c* and 78*d*, having mutually aligned central apertures which are coaxial with the input and output air fittings. The fan housing and motor are mounted within the two casing sections, which are pulled together in end to end juxtaposition, as shown in FIG. 3, by means of the tension producing bolts 50 and nuts 52. Sound and vibration deadening squares of rubber or asphalt sheet 92 are adhesively connected to the input end of the blower.

To assemble the unit, the annular insulation discs 78*a* through 78*d* are first inserted into casing section 10. The unitary subassembly of blower housing and motor are then press fit into the enlarged inner end 38 of casing section 10. The fan housing includes a ridge 84 extending around its outer periphery and projecting radially outwardly by a very small distance. The outer diameter of this ridge is slightly less than the inner diameter of the enlarged inner end section 38, whereas the outer diameter of the remainder of the fan housing is substantially equal to the inner diameter of inner end section 38. Moreover, as can be seen in the drawing, the outer diameter of the motor is significantly less than the inner diameter of the body section 24 of casing section 20.

The two casing sections 10 and 20 are substantially identical to one another in size, shape and dimensions except for the fact that casing section 10 is formed with the positioning and reinforcing fingers 54, whereas these are omitted from the casing section 20, and the latter, uniquely, is formed with the hexagonal apertures for receiving nuts 52, which hexagonal apertures are omitted from the bosses of the casing section 10.

To press fit the fan housing into the enlarged inner end 38 of casing section 10, the fan housing is tilted from axial alignment with the casing section, and the enlarged inner end of the flexible elastomeric casing section 38 is distorted and stretched as the fan housing section is forced first into the enlarged inner section at an angle, and then twisted to align the housing section with the axis of the casing section 10. During this insertion the enlarged inner end 38 is stretched as required to receive the slightly larger diameter ridge 84 of the housing section. The enlarged inner end remains stretched and somewhat distorted in the final position of the housing section, resiliently holding the fan housing.

Then the second casing section 20 is inserted over the motor and over the other end of the fan housing, with the several pairs of bosses 46 and 48 mutually aligned, whereby bolts 50 may be inserted through the bosses 46 and through the bosses 48. Nuts 52 are tightened to strongly pull the two casing sections toward one another securely clamping the fan housing within the chamber defined by the mutually facing enlarged inner ends of the casing sections. That end of the fan housing 70 which faces the input end of casing section 10 contacts and seats upon the ends 60 of the several fingers 54 (FIGS. 3 and 4), whereas the other end of the fan housing seats upon shoulder 44 formed at the junction of the enlarged inner end portion 40 and body section 24. Thus the fan housing and motor assembly are securely and firmly but resiliently clamped to and within the chamber formed by the two enlarged inner ends of the casing sections. The entire casing is made of flexible material, preferably injection molded, so that maximum sound deadening and vibration damping occurs and is provided.

Reinforcing and positioning fingers 54 surprisingly and unexpectedly improve the operation, preventing leakage of air from between the two casing sections and thereby avoiding the noise attendant upon such leak. This is so because, in operation, the output end of the blower tends to experience an increased static pressure, which may be in the order of two to four pounds per square inch. This pressure expands the casing section 24 slightly and tends to force air backwardly toward the inlet and between the sealing ridge 84 of the blower housing and the inner surface of the elastomeric enlarged inner end 40. Air flowing past this sealing ridge, which because of the resilience of the casing is not a perfect seal under pressure, may flow past the enlarged inner end section 40 of casing section 20 and thence over that end of the fan housing closer to the input fitting, flowing between the fingers and between the fan housing and the inner surface of enlarged inner end 38. If the fingers were not present, the input end of the fan housing would rest directly upon the shoulder 42 between the enlarged inner end and the casing body with the length of the inner ends 38,40 slightly decreased. In such case, air flowing backwardly may not as readily flow into the interior of body section 24 of casing 20, being blocked by the continuous seating of the fan housing end upon the continuous elastomeric shoulder 42. Therefore the increased static pressure would tend to force outwardly the adjoining free edges of enlarged inner sections 38,40, which would thus separate and allow air to leak from the casing. This type of leakage may decrease efficiency of the blower, and, moreover, increase the escaping noise. However, with the fingers 54 provided as described, static pressure at the joint between the abutting edges of inner sections 38,40 may be slightlky relieved by flow rearwardly between the fingers.

It is believed that the reinforcing and positioning fingers 54 strengthen and reinforce the enlarged inner section 38, providing a slightly increased stiffening for this element, and, moreover, provide for a path of flow of static air rearwardly into the interior of casing body 20, thereby minimizing escape of air through and between the abutting edges of enlarged inner sections 38 and 40.

An additional advantage of making the casing sections of soft elastomeric material is the fact that the electrical cord 90, providing electrical power to the motor, may be most simply and readily sealed to the casing section as it enters the casing section 20 without the use of extra sealing arrangements, such as grommets and the like. An aperture is formed in the wall of casing 20 which is slightly smaller than the exterior diameter of the electric cord 90. The latter is lubricated as it is forced through the aperture of the casing, which elastically enlarges to thereby tightly and sealingly engage over and around the exterior of the cord so that no additional sealing is necessary. This sealing engagement of the cord and the body is desirable because, as previously mentioned, the interior of the casing is subject to a higher static pressure, particularly at casing section 20, and escaping air will decrease efficiency and increase generated noise.

The described design provides for the maximized efficiency and minimum noise generation in an air blower in that the entire casing, including supporting legs, of the motor blower assembly is made of a soft, resilient elastomeric material which absorbs rather than transmits vibration damper. Moreover, the straight flow through design, wherein the input and output fittings are axially aligned with the axis of the casing and with the axes of the blower and motor, with the air flow directed axially through the motor blower assembly, provides for the simplest and most noise free air path. The parts are simply made by injection molding, and assembly time and effect are minimum and exceedingly simple. No separate and different casing parts are needed to make rigid casing sections or special vibration dampening motor mounts, since the entirety of the casing constitutes a vibration dampening and sound insulating mounting for the motor blower assembly.

The foregoing detailed description is to be clearly understood as given by way of illustration and example only, the spirit and scope of this invention being limited solely by the appended claims.

What is claimed is:

1. An air blower for a spa, therapy pool or the like comprising:

a generally cylindrical fan housing having a fan therein, a motor fixed to the fan housing and having a diameter less than the diameter of the fan housing, first and second casing sections formed of a relatively soft resilient plastic material, each said casing section comprising:

a cylindrical body having a first diameter and an enlarged open inner end, said enlarged inner ends collectively defining a fan housing receiving chamber configured and arranged to closely and tightly envelope said fan housing with inner edges of said enlarged inner ends in close engagement with each other, said housing being captured within said receiving chamber with said motor received in one of said casing sections, and means for axially drawing said casing sections toward each other to firmly and securely clamp said fan housing therebetween, whereby pressure exerted upon said housing by said enlarged inner ends securely and tightly mounts the fan housing to and within said casing sections.

2. An air blower for a spa, therapy pool or the like comprising:

a generally cylindrical fan housing having a fan therein, a motor fixed to the fan housing and having a diameter less than the diameter of the fan housing, first and second casing sections formed of a relatively soft resilient plastic material, each said casing section comprising:

a cylindrical body having a first diameter and an enlarged open inner end, said enlarged inner ends collectively defining a fan housing receiving chamber configured and arranged to closely and tightly envelope said fan housing with inner edges of said enlarged inner ends in close engagement with each other, said housing being captured within said receiving chamber with said motor received in one of said casing sections, and means for axially drawing said sections toward each other to firmly and securely clamp said fan housing therebetween, whereby pressure exerted upon said housing by said enlarged inner ends securely and tightly mounts the fan housing to and within said casing sections, each said casing section having an outer end opposite its enlarged open inner end and including an air fitting attached to the closed end, said first casing section having a plurality of radially extending fingers projecting axially within said enlarged inner end from a portion of said cylindrical body having said first diameter, said fingers being mutually spaced around an inner surface of said enlarged open inner end of said first casing section and terminating at a position inwardly of the inner edge of said first casing section, each said finger having an end pressed axially against an end of said fan housing.

3. The air blower of claim 1 wherein of the enlarged open end of said second casing section joins a portion of the cylindrical body having said first diameter to define an axially inwardly facing peripheral shoulder, and including means in said enlarged open inner end of said first casing section for pressing said fan housing axially against said shoulder.

4. An air blower for a spa, therapy pool or the like comprising:

a generally cylindrical fan housing having a fan therein, a motor fixed to the fan housing and having a diameter less than the diameter of the fan housing, first and second casing sections formed of a relatively soft resilient plastic material, each said casing section comprising:

a cylindrical body having a first diameter and an enlarged open inner end, said enlarged inner ends collectively defining a fan housing receiving chamber configured and arranged to closely and tightly envelope said fan housing with inner edges of said enlarged inner ends in close engagement with each other, said housing being captured within said receiving chamber with said motor received in one of said casing sections, and means for axially drawing said casing sections toward each other to firmly and securely clamp said fan housing therebetween, whereby pressure exerted upon said housing by said enlarged inner ends securely and tightly mounts the fan housing to and within said casing sections, said air blower including a plurality of fingers secured to and mutually spaced around the inner surface of the enlarged inner end of said first casing section and extending axially from the junction of said enlarged inner end and a portion of said cylindrical body of first diameter to a point inwardly of the inner edge of said first casing section, said fingers projecting radially inwardly from the inner surface of said enlarged inner end of said first casing section, said fingers reinforcing and stiffening circumferentially spaced areas of the enlarged inner end of said first casing section and being pressed against one end of said fan housing.

5. The air blower of claim 4 wherein said means for axially drawing said sections toward each other comprise a plurality of axially extending and circumferentially spaced pairs of axially aligned bosses on outer surfaces of the enlarged inner ends of said first and second casing sections, and fastening members respectively extending through each pair of aligned bosses for securely clamping the first and second casing sections axially together.

6. The air blower of claim 5 wherein each said casing section is formed with an integral pair of mutually spaced support legs.

7. An air blower for a spa, therapy pool or the like comprising:

a generally cylindrical fan housing having a fan therein, a motor fixed to the fan housing and having a diameter less than the diameter of the fan housing, first and second casing sections formed of a relatively soft resilient plastic material, each said casing section comprising:

a cylindrical body having a first diameter and an enlarged open inner end, said enlarged inner ends collectively defining a fan housing receiving chamber configured and arranged to closely and tightly envelope said fan housing with inner edges of said enlarged inner ends in close engagement with each other, said housing being captured within said receiving chamber with said motor received in one of said casing sections, and means for axially drawing said sections toward each other to firmly and securely clamp said fan housing therebetween, whereby pressure exerted upon said housing by said enlarged inner ends securely and tightly mounts the fan housing to and within said casing sections, said fan housing including a peripheral ridge projecting slightly radially outwardly, said ridge having an outer diameter slightly greater than the inner diameter of the enlarged open end of said first casing section, whereby said fan housing is inserted into said first casing section by resiliently deforming and stretching said first casing section inner end, and said first casing section inner end remains resilient distorted about and in close sealing engagement with said housing ridge.

8. The air blower of claim 7 wherein said first casing section includes a plurality of circumferentially spaced reinforcing fingers integral with said enlarged open inner end thereof and having free ends forming axially facing seats positioned inwardly of the inner edges of said first casing section, said seats collectively bearing upon and pressed against an end of said fan housing to urge the fan housing toward the cylindrical body of said second casing section.

9. In the manufacture of an air blower for a therapy pool, spa or the like having a blower casing, and a motor and fan housing mounted within the casing, said fan housing having a fan therein, an improved method for mounting the motor and fan housing comprising the steps of:

forming first and second flexible resilient open ended casing sections of a relatively soft, resilient plastic material having mutually mating enlarged open ends configured and arranged to cooperate with each other to jointly define a fan housing receiving chamber that will securely and resiliently receive and capture the fan housing, pressing part of said fan housing into one of said enlarged open ends by resiliently distorting and stretching said one enlarged open end, moving the other of said enlarged open ends over said fan housing to cause the fan housing to enter the enlarged end of said second casing section and to cause the enlarged open ends of the two casing sections to abut one another, and axially urging said casing sections toward one another to axially press and resiliently capture the fan housing and motor between the two casing sections in said housing receiving chamber.

10. The method of claim 9 wherein said step of forming includes forming a plurality of fingers integral with and spaced around the inner surface of the other of said enlarged ends, said step of moving the other of said enlarged open ends comprising pressing ends of said fingers axially against an end of said fan housing.

11. An air blower for a spa, therapy pool or the like comprising:

a cylindrical fan housing, having a fan therein, having a housing external diameter and having a housing length, a motor fixed to the fan housing and having a diameter less than the housing external diameter, first and second open ended casing sections of generally cylindrical configuration formed of a relatively soft elastomeric material, each said casing section comprising:

a cylindrical body section having a body diameter less than said housing external diameter and having a closed end, an air fitting connected to said closed end for passing air between the exterior and interior of said body section, an enlarged open inner end section formed in the cylindrical body section opposite said closed end having an inner diameter substantially equal to said housing external diameter and having free inner edges, said enlarged inner end sections of said first and second casing sections cooperating to define a fan housing receiving chamber configured and arranged to closely envelope said fan housing, said fan housing being captured within said receiving chamber with said motor extending into said first casing section, a circumferentially extending ridge element on an exterior surface of said fan housing and having an outside diameter slightly greater than the inside diameter of the enlarged end section of said first casing section, one end of said fan housing and ridge element being a press fit within the enlarged end section of said first casing section, whereby the elastomeric material of the enlarged end section of said first casing section is outwardly stressed and deformed by the fan housing and its ridge element to provide a tight press fit therebetween, said casing sections being positioned with inner edges of said end sections in abutment with one another, a portion of said fan housing being received in the enlarged open inner end of said second casing section, tension means for exerting axial tension to pull said first and second casing sections toward each other to firmly and securely clamp the fan housing therebetween, said first casing section enlarged inner end section including means for pressing against one end of said fan housing to urge said fan housing into said enlarged inner end section of said second casing section, whereby the axial tension exerted upon said casing sections by said tension means firmly clamps the fan housing between and within said enlarged inner end section of said casing sections.

12. The air blower of claim 11 wherein said means for pressing comprises a plurality of fan housing positioning and end section reinforcing fingers formed integrally with the inner surface of said enlarged inner end section of said first casing section, said fingers being mutually spaced around said surface, each said finger having an end forming an axial seat for an end of said fan housing, and all said seat being positioned in a common plane at a predetermined fixed distance axially inwardly of the inner edge of said second casing enlarged section, whereby the pull of said tension means presses said axial seats against said end of the fan housing to firmly clamp the fan housing within said receiving chamber.

13. The air blower of claim 12 wherein said fan housing and motor includes means for flowing air axially therethrough, and wherein said air fittings are aligned axially with each other, with said fan housing and motor, and with said casing sections, to flow air axially through the entire air blower.

14. An air blower for a therapy pool, spa or the like comprising:

a cylindrical fan housing having a fan therein, having a housing external diameter and having a housing length, a motor fixed to the fan housing and having a motor diameter less than said housing external diameter, and a generally cylindrical casing enclosing and mounting said housing and motor and formed of a soft resilient plastic, said cylindrical casing comprising:

a cylindrical body having closed cylindrical input and output end sections of a diameter less than said housing diameter and at least one of said end sections having a diameter greater than said motor diameter, input and output air fittings connected to said input and output end sections, respectively, an intermediate cylindrical section between said input and output end sections having an internal diameter greater than the diameter of said end sections and having a length not less than said housing length, said fan housing being press fit within said intermediate section and said motor being positioned within said at least one of said end sections, and means for pressing said fan housing into said intermediate section.

15. The air blower of claim 14 wherein said motor and fan housing are configured and arranged to flow air axially therethrough, said air fittings being aligned axially of said cylindrical casing and positioned substantially at centers of the respective input and output end sections.

16. The air blower of claim 15 wherein said cylindrical casing is formed of first and second parts, said first part including said input end section and an input portion of said intermediate section, said second part including said output section and an output portion of said intermediate section, said means for pressing said fan housing comprising a plurality of axially tensioned fastener means fixed to said intermediate section for axially pulling said input and output portions of said intermediate section toward each other to press said fan housing within said intermediate section.

17. The air blower of claim 16 including a plurality of fingers fixed to and circumferentially spaced about the interior of said intermediate section input portion, said fingers being pressed against one end of said fan housing, the other end of said fan housing being pressed against said cylindrical body output section, thereby clamping said fan housing within said intermediate section.

18. The air blower of claim 17 wherein each of said casing parts is an individual integrally molded part.

19. An air blower for a spa, therapy pool or the like comprising:

a generally cylindrical fan housing having a fan therein, a motor fixed to the fan housing and having a diameter less than the diameter of the fan housing, first and second casing sections formed of a relatively soft resilient plastic material, each said casing section comprising:

a cylindrical body having a first diameter and an enlarged open inner end, said enlarged inner ends collectively defining a resilient fan housing receiving chamber configured and arranged to closely and tightly envelope said fan housing with inner edges of said enlarged inner ends in close engagement with each other, said housing being a press fit within and distorting said resilient receiving chamber with said motor received in one of said casing sections, and means for axially drawing said casing sections toward each other to firmly and securely and resiliently clamp said fan housing therebetween, whereby pressure exerted upon said housing by said enlarged inner ends stretches and distorts said chamber, and securely and tightly and resiliently mounts the fan housing to and within said casing sections.

* * * * *